United States Patent [19]

Antosko

[11] Patent Number: 4,775,391

[45] Date of Patent: Oct. 4, 1988

[54] FUEL PACKAGE

[76] Inventor: Henry B. Antosko, 16 Harrow Place, Beaconsfield, Quebec H9W 5C7, Canada

[21] Appl. No.: 71,009

[22] Filed: Jul. 8, 1987

[51] Int. Cl.[4] ..... C10L 11/00; C10L 5/14

[52] U.S. Cl. ..... 44/520; 44/25; 44/532; 44/541

[58] Field of Search ..... 44/40, 38, 41, 21, 25, 44/520, 522, 532, 541, 542

[56] References Cited

U.S. PATENT DOCUMENTS

| | | | |
|---|---|---|---|
| 2,206,362 | 7/1940 | Mulcey | 44/40 |
| 2,240,335 | 4/1941 | Keil | 44/40 |
| 2,666,695 | 1/1954 | Brody | 44/40 |
| 2,849,300 | 8/1958 | Berman et al. | 44/40 |
| 2,963,352 | 12/1960 | Davis | 44/40 |
| 3,010,809 | 11/1961 | Peck | 44/40 |
| 3,034,873 | 5/1962 | Weir | 44/40 |
| 3,056,665 | 10/1962 | Linda et al. | 44/40 |
| 3,231,346 | 1/1966 | Wilder | 44/41 |
| 3,269,807 | 8/1966 | Key | 44/40 |
| 3,279,900 | 10/1966 | Naples | 44/40 |
| 3,385,282 | 5/1968 | Lloyd | 126/25 |
| 3,385,681 | 5/1968 | Mennen | 44/17 |
| 3,485,599 | 12/1969 | Richardson | 44/17 |
| 3,759,675 | 9/1973 | Lazarus et al. | 44/38 |
| 3,846,086 | 11/1974 | Balch | 44/40 |
| 3,877,886 | 4/1975 | Dalzell | 44/40 |
| 4,063,904 | 12/1977 | Beeson | 44/40 |
| 4,074,977 | 2/1978 | Dunham et al. | 44/38 |
| 4,083,697 | 4/1978 | Smith et al. | 44/25 |
| 4,101,292 | 7/1978 | Hogan | 44/40 |
| 4,165,968 | 8/1979 | Duncan | 44/41 |
| 4,202,669 | 6/1980 | Ball | 44/40 |
| 4,225,318 | 9/1980 | Wrigley | 44/40 |
| 4,437,862 | 3/1984 | Whang | 44/6 |
| 4,460,377 | 7/1984 | Kalil | 44/40 |

*Primary Examiner*—Carl F. Dees

*Attorney, Agent, or Firm*—Fetherstonhaugh & Co.

[57] ABSTRACT

An improved fuel package comprising fuel pieces, a combustible moisture proof container for holding the fuel pieces in a specific shape, and combustible binder/-starter composition for binding together a large proportion of the fuel pieces into a stack within the container to promote combustion of the fuel pieces when the container is ignited.

The invention is also directed toward a method of making the fuel package and hermetically sealing it.

14 Claims, 1 Drawing Sheet

FUEL PACKAGE

This invention is directed toward an improved fuel package, and to a method for making the improved fuel package.

Fuel packages, either for starting or making fires, are well known. The fuel packages, when employed as fire starters, usually comprise a combustible container filled with a mixture of solid fuel pieces and a meltable, combustible, binding material such as paraffin wax that holds the fuel pieces in the container. An example of such a fire starter is shown in U.S. Pat. No. 3,756,675 by way of example. In this type of fire starter, the binding material completely fills the spaces between the fuel pieces. Since fire starters are relatively small, only a relatively small amount of binder material is needed, even when filling all the voids.

Fuel packages for making fires are usually larger than fire starters and employ larger fuel pieces within a closed combustible container with some sort of ignition, or combustion aiding means in the container. U.S. Pat. Nos. 2,240,335; 3,034,873 and 4,460,377 for example, all disclose fuel packages employing loose charcoal briquettes packed within a closed container with a fire ignition or starting means within the container. U.S. Pat. No. 2,240,335 discloses the starting means as being areas of wax coatings on the briquettes. U.S. Pat. Nos. 3,034,873 and 4,460,377 disclose the containers as being made of rigid cardboard. U.S. Pat. No. 4,063,904 also discloses a closed combustible container holding fuel pieces consisting of wood with some of the wood pieces partially coated with wax and with additional ignition means.

The known fuel packages would appear to provide an easy and clean method of starting and maintaining fires, particularly fires involving the use of coal or charcoal since the coal or charcoal need not be handled. However, many of the known fuel packages are very complicated in construction particularly in the container structure and in the ignition means. Further, many of the known fuel packages have difficulty in igniting the fuel pieces since once the container burns, the loose fuel pieces spread apart hindering burning.

It is the purpose of the present invention to provide an improved fuel package that is simple in construction and thus relatively inexpensive to manufacture. It is another purpose of the present invention to provide an improved fuel package that is easy to operate, and that is also more reliable in starting than known fuel packages. It is a further purpose of the present invention to provide an improved method of making the improved fuel packages that is relatively simple and inexpensive and that ensures that the packages are of a required weight conforming to the packaging regulations relating to this consumer commodity.

In accordance with the present invention, there is provided an improved fuel package consisting of a moisture proof combustible container which holds a charge of fuel pieces in a specific shape and a combustible binder/starter composition which holds at least a large portion of the fuel pieces together in a stack to promote combustion. The binder/starter composition that holds the fuel pieces together in a stack also helps to promote combustion. With at least some of the fuel pieces initially held together in a stack during the start of burning, combustion of these fuel pieces is promoted and when the stack finally collapses, the fuel pieces are well lit and continue to burn to provide a usable fire in a very short time.

The present invention is also directed toward a method for making the improved fuel package which comprises the steps of filling an open combustible moisture proof container with the fuel pieces and then distributing at least a minimum amount of combustible binder/starter composition over at least some of the fuel pieces in the container to bind them together in a stack to promote combustion. The container is then weighed, and if it is not of a required minimum weight, additional binder/starter composition can be added to bring the package up to the required weight. The package is then hermetically sealed.

The invention is particularly directed toward an improved fuel package comprising a charge of pieces of fuel and a hermetically sealed and moisture proof container for packaging the charge of fuel, which container serves as a mold for holding the charge of fuel pieces loaded into the container in a specific shape. The container is made of moisture proof combustible material to aid in starting combustion of the fuel pieces. The package also contains a binder/starter composition for binding at least 40% of the pieces of fuel together within the container to form a stack of bound fuel pieces to promote combustion of the fuel pieces when the package is ignited. The binder/starter composition is itself combustible to promote combustion of the fuel pieces.

The invention is also particularly directed toward a method for making a fuel package from a moisture proof combustible container having an open top with a foldable cover, fuel pieces and combustible binder/-starter composition, comprising the steps of filling the container while open with a charge of fuel pieces and then pouring the liquid binder/starter composition over at least some of the fuel pieces within the container to at least partly coat the fuel pieces and bind them together into a stack as the composition hardens and then closing and hermetically sealing the container with the foldable cover.

The method includes an additional step of weighing the package before closing the container and, if needed, adding additional binder/starter composition to the container to bring the package up to a correct weight before closing the container.

The invention will now be described in detail having reference to the accompanying drawings in which.

Figures 1, 2, 3:
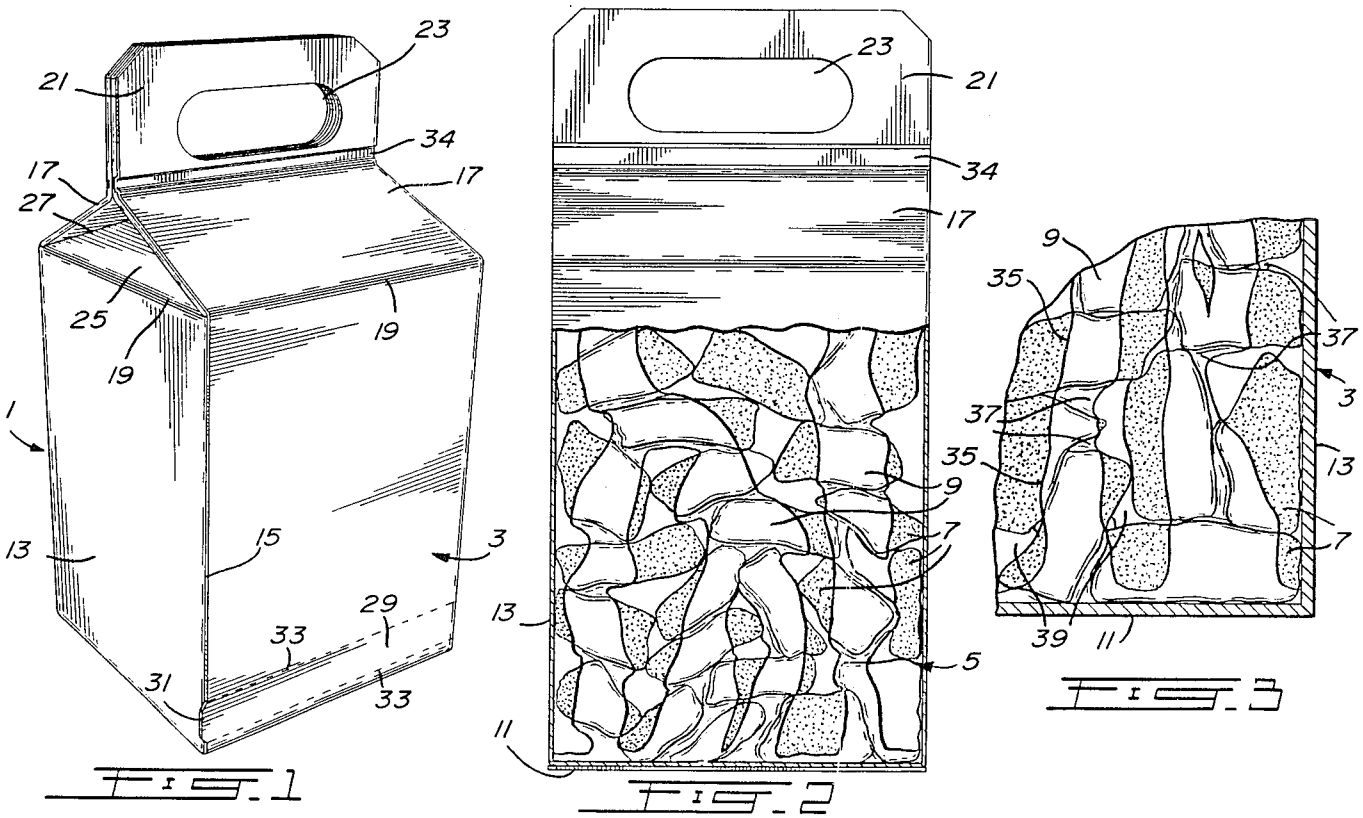
FIG. 1 is a perspective view of an improved fuel package according to one embodiment of the present invention.
FIG. 2 is a cross sectional view of the container showing the fuel pieces therein.
FIG. 3 is a detail view of the fuel pieces in the fuel package.

Referring now to the drawings, the improved fuel package 1 of the present invention, has a container 3 holding a charge 5 of fuel pieces 7. A binder/starter composition 9 holds at least close to half of the fuel pieces 7 together to promote improved burning of the fuel pieces when the package 1 is burned.

The container 3 is made of combustible material which is moistureproof and of material sufficiently rigid and strong to give the package a permanent, specific shape. A suitable container material is cardboard polycoated on both surfaces which can also be printed on to advertise the product, and to give instruction as to use. The cardboard container 3 is formed from a blank that is cut; scored and/or folded; and glued, to provide an elongate container 3 of square or rectangular transverse cross section shape as shown in the drawings.

A base 11 for the container 3 is formed of two overlapping flaps glued together. Side walls 13 have a glued overlapping join 15 at one corner. The top of the container 3 has two opposing sloping flat top sides 17 which each fold inward about a bend line 19. This bend line 19 extends around the top of all four side walls 13 of the container 3. The two flat top sides 17 each join to a handle portion 21 extending across the top and at the centre of the container 3. An aperture 23 in the handle portion 21 forms a convenient carrying handle. The other two opposing top sides 25 also fold inward about the bend line 19 and have angled fold lines 27 which permit the two top sides 25 to fold and fit within the angle formed by the flat two sides 17. The interior of the container 3 may be lined with a plastic film or a layer of impermeable material such as wax to provide a moisture proof container and prevent the escape of dust and/or dirt from the container 3.

A perforated tear strip 29 is provided along the lower surface of one container wall 13. A tab 31 at the overlapping join 15 allows the tear strip 29 to be gripped and torn open. During construction of the container, an adsorbent is applied underneath the tab 31 to prevent lamination of the tear strip 29 at the overlapping join 15. Perforations 33 along each side of the tear strip 29 permit the tear strip 29 to be pulled. A liquid sealer is applied to the perforations 33 after they have been made to seal perforation holes and prevent leakage and escape of fumes from within the container. The tear strip 29 is used to ignite the fuel package and also aids in creating draft openings in the package to help promote combustion as will be described.

The container 3 is filled with a charge 5 of fuel pieces 7. The fuel pieces 7 can comprise pieces or lumps of coal, coke, charcoal, charcoal briquettes or wood. Cannel coal is a preferred coal as this produces high heat, up to 15,000 B.T.U.'s per pound. The fuel pieces 7 are arranged closely adjacent to each other and are piled on top of each other. The fuel pieces 7 can comprise charcoal briquettes of the same size. However, the fuel pieces 7 can also vary in size, preferably up to about 3 inches at a largest dimension. It is preferred to have about eighty percent of the fuel pieces ranging in size between one and two inches; about ten percent of the fuel pieces less than one inch in size; and about ten percent of the fuel pieces larger than two inches in size.

A combustible binder/starter composition 9 is also present in the filled container. The binder/starter composition binds at least some of the fuel pieces together and also promotes combustion.

A suitable binder/starter composition is made up of a commercially available resin and solvent mixture. One example is a kerosene based formaldehyde resin such as ureaformaldehyde in an emulsion form, to which a surfactant or detergent and water mixture is added and mechanically agitated forming a highly absorbent stable gel or foam. The composition is formed when a mixture of kerosene along with a hydrochloric acid former properly buffered is added (at a ratio of about 10 to 1) to the stable gel or foam. This mixture is then mechanically agitated and poured onto the fuel pieces 7 in the container 3. Solidification occurs in about 10 to 15 minutes.

In another embodiment the binder/starter composition is a paraffin wax. Other types of waxes, combinations of waxes, or combustible-binder substances may also be used. The binder/starter composition 9 is present in sufficient quantity, and distributed in the container in such a manner so as to cause a large portion of the fuel pieces 7 in the container to adhere to each other. Sufficient binder/starter composition 9 is present and distributed in a manner to cause at least forty percent of the fuel pieces 7 to adhere to each other to form a stack. In addition, the binder/starter composition coats a large percentage of the surface area of each fuel piece in the stack.

The amount of binder/starter composition used depends on the type of fuel pieces used and the particle size distribution. The following table indicates the minimum amount of binder/starter composition required, in proportion to the amount of fuel, for the different types of fuel:

| TYPE OF FUEL | AMOUNT OF BINDER/STARTER COMPOSITION AS A % OF TOTAL PACKAGE WEIGHT |
|---|---|
| Coal (including cannel coal & coke) | 8 to 10% |
| Charcoal briquettes | 5 to 8% |
| Hardwood charcoal lumps | 3 to 5% |
| Hardwood pieces | 2 to 3% |

It will be seen that the harder fuels require more binder/starter.

The fuel package 1 is manufactured in a novel manner. The container 3 is first formed and coated on the inside and/or the outside to provide a sealed container which is also moisture proof. Then with the flat top sides 17 vertical so the container is open, it is used as a mold to receive and shape a charge of fuel pieces 7. The open, filled container 3 can be shaken to compact the fuel pieces 7 and additional fuel pieces may be added to fill up the container 3. The binder/starter composition is then poured over at least a portion of the fuel pieces 7 in the container 3 to at least partially coat and bind those fuel pieces 7 together. The binder/starter composition drips and flows down around and between the fuel pieces partially coating areas 35 of the fuel pieces 7 as shown in FIG. 3 and binding them together in regions 37 where they abut as the binder/starter composition hardens. The bound fuel pieces form a stack 27 that retains its shape during ignition of the fuel so as as to promote better burning. Once the required amount of binder/starter composition has been added, the two top sides 25 are folded in and the flat top sides 17 are folded about the fold line 19 and sealed at 34 to completey close the container 3. It will be noted that all the voids 39 in the stack 27 need not be filled with binder/starter composition. Preferably, each package is weighed after the fuel pieces and binder/starter composition have been added. If necessary, additional binder/starter composition over and above the minimum amount needed to bind and coat the fuel pieces 7, can be added to the container 3 while it is still open after weighing to bring the fuel package 1 up to a desired or required minimum weight. Once the package 1 is at the correct weight, it is hermetically sealed at 34. This provides a completey sealed package 1 which is moisture proof.

In a preferred method, the container can be half filled with the full pieces 7, shaken and then half of the binder/starter composition can be poured over these fuel pieces. The binder/starter composition is poured in a manner to try to evenly distribute it over all of the fuel pieces. After the binder/starter composition has solidified, the top half of the container can be filled with additional fuel pieces, shaken, and then the remainder of the starter and binder composition can be poured over the additional fuel pieces again in an evenly distributed manner.

The fuel package 1 is easily employed by pulling the tab 3 to open the tear strip 29. The package is ignited by lighting the end of the tear strip so that the container itself and the binder/starter composition start burning and then ignite the fuel pieces. The package may also be ignited by pulling off the tear strip 29 completely and lighting the edge of the container at this open strip. Initially the opening created by pulling the tear strip 29 promotes drafts within the container to assist in burning. As the container burns away, the stack of fuel pieces 7 retains its shape while the container and binder/starter composition ignite and burns to further help promote combustion.

Various changes may be made to the embodiments described herein without departing from the scope of the present invention which is limited only by the following claims.

The embodiments of the invention in which an exclusive property or privilege is claimed are defined as follows:

1. An improved fuel package comprising:

a charge of pieces of fuel with the majority of the pieces having a size ranging between one and two inches;

a hermetically sealed and moisture proof container for packaging the charge of fuel, the container made of cardboard to aid in starting combustion of the fuel pieces and having a top loading opening and means for closing the opening; the container serving as a mold for holding the charge of fuel pieces in the shape of the container when the fuel pieces are loaded into the container through the top opening; and a pourable, hardenable binder/starter composition for binding at least 40% of the fuel pieces together within the container to form a self-supporting stack of bound fuel pieces to promote combustion of the fuel pieces when the fuel package is ignited, the binder/starter composition made from combustible material to promote combustion of the fuel pieces.

2. An improved fuel package as claimed in claim 1 wherein the binder/starter composition at least partially coats said pieces of fuel.

3. An improved fuel package as claimed in claim 2 wherein the means for closing the opening comprises a foldable cover and wherein the cardboard has a moisture proof coating on at least one surface.

4. An improved fuel package as claimed in claim 3 wherein the container has at least one tear strip that can be torn away to provide an ignition area for the package.

5. An improved fuel package as claimed in claim 4 wherein the tear strip can be partly torn away to provide an ignition tab for the package, the tear strip located to provide a draft opening for the package when torn.

6. An improved fuel package as claimed in claim 1, wherein the binder/starter composition comprises a kerosene based formaldehyde resin in a stable gel or foam.

7. An improved fuel package as claimed in claim 1 wherein the binder/starter composition comprises a ureaformaldehyde mixed with kerosene in a stable gel or foam.

8. An improved fuel package as claimed in claim 1 wherein the binder/starter composition comprises a paraffin wax.

9. An improved fuel package as claimed in claim 1 wherein the fuel pieces are selected from the group consisting of coal, coke, cannel coal, charcoal briquettes, hardwood charcoal lumps and wood.

10. An improved fuel package as claimed in claim 1 wherein about eighty percent of the fuel pieces range in size between one and two inches.

11. An improved fuel package as claimed in claim 3 wherein the foldable cover means comprises two portions which have an aperture therein forming a carrying handle.

12. A method for making a fuel package from a moisture proof, cardboard container having an open top with a foldable cover means; fuel pieces with the majority of the pieces having a size ranging between one and two inches; and pourable, hardenable binder/starter composition comprising the steps of:

filling the container, while open, with a charge of fuel pieces;

pouring the binder/starter composition over at least some of the fuel pieces within the container to at least partially coat the fuel pieces and to bind them together into a self-supporting stack as the binder/-starter composition hardens;

and closing the container with the foldable cover means and hermetically sealing the container.

13. A method as claimed in claim 12 including the step of weighing the package before closing the container, and, if needed, adding additional binder/starter composition to the container to bring the package up to a minimum weight before closing the container.

14. A method as claimed in claim 12 wherein the step of adding the fuel pieces and binder/starter composition to the container is split in about half so that about half of the fuel pieces and binder/starter composition are added in a first step, and after the binder/starter composition has hardened, the rest of the fuel pieces and binder/starter composition are added on top of the first half.

* * * * *